US010322915B2

(12) United States Patent
Kaupert et al.

(10) Patent No.: US 10,322,915 B2
(45) Date of Patent: Jun. 18, 2019

(54) MECHANICAL LOCKING HEAD

(71) Applicant: Manitowoc Crane Group France SAS, Dardilly (FR)

(72) Inventors: Gerhard Kaupert, Varel (DE); Bernd Backes, Oberthal (DE); Johannes Schürmann, Jever (DE)

(73) Assignee: MANITOWOC CRANE GROUP FRANCE SAS, Dardilly (FR)

( * ) Notice: Subject to any disclaimer, the term of this patent is extended or adjusted under 35 U.S.C. 154(b) by 0 days.

(21) Appl. No.: 14/455,688

(22) Filed: Aug. 8, 2014

(65) Prior Publication Data

US 2015/0041422 A1 Feb. 12, 2015

(30) Foreign Application Priority Data

Aug. 9, 2013 (EP) ..... 13179854

(51) Int. Cl.
*B66C 23/70* (2006.01)

(52) U.S. Cl.
CPC ..... *B66C 23/708* (2013.01)

(58) Field of Classification Search
CPC ..... B66C 23/708
USPC ..... 212/292
See application file for complete search history.

(56) References Cited

U.S. PATENT DOCUMENTS 2,309,588 A * 1/1943 Hillix ..... B24B 35/00 29/DIG. 50
3,154,206 A * 10/1964 Gillette, Jr. ..... B64F 5/0036 254/2 R
4,303,165 A * 12/1981 Cassens ..... B66C 23/702 212/300
5,183,305 A * 2/1993 Nordstrom ..... B66C 1/102 294/81.1

FOREIGN PATENT DOCUMENTS

CN 102730578 A 10/2012
DE 198 24 672 A1 12/1998
DE 100 04 838 A1 9/2000
(Continued)

OTHER PUBLICATIONS

HydraulicsPneumatics.com Web Page, Titled: Technology Zones, Jan. 4, 2010 (Year: 2010).*
(Continued)

*Primary Examiner* — Michael R Mansen
*Assistant Examiner* — Juan J Campos, Jr.
(74) *Attorney, Agent, or Firm* — Levenfeld Pearlstein, LLC

(57) ABSTRACT

A locking head is configured such that it can be moved within and along the longitudinal axis of a telescope, which comprises at least two telescope sections, by means of a telescoping device, comprising a base body, at least one releasing device which is configured to release a telescope section lock and at least one coupling device which is configured to couple a telescope section with the telescoping device. The locking head comprises an operating member
(Continued)

which mechanically acts on the releasing device and the coupling device in order to operate the releasing device and the coupling device. The operating member comprises a first link guide for the releasing device and a second link guide for the coupling device, wherein the links for the first and second link guides extend in a single plane or in parallel planes.

12 Claims, 8 Drawing Sheets

(56) References Cited

FOREIGN PATENT DOCUMENTS

| | | | |
|---|---|---|---|
| DE | 10 2011 116083 | A1 | 4/2013 |
| EP | 0 754 646 | A1 | 1/1997 |
| EP | 0 943 580 | A2 | 9/1999 |
| EP | 1 153 875 | A1 | 11/2001 |
| JP | S5613489 | U | 2/1981 |
| JP | 2006282342 | A | 10/2006 |
| WO | WO 2012/083664 | A1 | 6/2012 |

OTHER PUBLICATIONS

Machine Translation DE 102011116083 (Year: 2013).*
Machine Translation CN 102730578 (Year: 2012).*
European Search Report for corresponding EP Application No. 13179854.8-1705, dated Dec. 13, 2013 (7 pages).

* cited by examiner

MECHANICAL LOCKING HEAD

RELATED APPLICATIONS

The present patent document claims the benefit of priority to Europe Patent Application No. 13179854.8-1705, filed Aug. 9, 2013, and entitled "MECHANICAL LOCKING HEAD," the entire contents of each of which are incorporated herein by reference.

BACKGROUND

The invention relates to a locking head for a crane jib comprising at least two telescope sections.

In the case of larger cranes and mobile cranes with telescopic jibs, the individual telescope sections of the jib are usually moved relative to one another by means of a telescoping device in order to extend and retract the jib in a telescoping movement. Such cranes with a telescopic jib and a locking head are already known from EP 0 943 580 B1 and EP 1 153 875 B1. On the end at which the piston rod extends out from the cylinder, the telescoping device used for this purpose has a locking head which can be moved by the telescoping device in the longitudinal direction of the jib and essentially fulfils two functions. Firstly, before extending or retracting the respective telescope sections, the lock between the telescope section to be moved and the next outer telescope section has to be released and locked again at another point after the extending or retracting operation. Secondly, the telescope section which has to be moved has to be coupled respectively with the locking head and hence with the telescoping device so that an extending or retracting movement of the telescoping device causes an extending or retracting movement of the respective telescope section. In this respect, it is necessary to ensure that the respective telescope section is coupled with the locking head before the lock with the next outer telescope section is released and that it is not uncoupled from the locking head again until the lock with the next outer telescope section has been established.

EP 0 754 646 B1 discloses a locking head, whereby in order to increase operating safety, hydraulic circuits are controlled by drivers positioned by the locking bolts to be moved so that the telescope sections cannot be unlocked until the drivers have been positioned on the telescope section to be moved and conversely, the drivers cannot be released from the telescope section to be moved until the lock between two telescope sections has been established again.

DE 100 04 838 discloses a locking head, whereby the locking head is coupled by means of a first hydraulic cylinder and the lock between the individual telescope sections is operated by means of a second hydraulic cylinder. As a result, different power sources are provided for the coupling device and the locking device.

DE 198 24 672 discloses a locking head which is provided in the form of a bush and is displaceable on the cylinder housing of a piston-cylinder unit. A piece with two guide grooves which can be displaced relative to the locking head is provided as a means of operating locking bolts, and a guide ring disposed perpendicular to it and which engages in another guide groove is provided as a means of operating a telescope section lock.

BRIEF SUMMARY

The objective of this invention is to increase the operating safety of a locking head that is as simple as possible in terms of structural design. This objective is achieved on the basis of the embodiments described below that define features offering further advantages to the principle underlying the invention.

In accordance with this invention, the locking head is configured such that it can be moved by means of a telescoping device within and along the longitudinal axis of a crane jib comprising at least two telescope sections. The locking head comprises a base body, at least one releasing device configured to release a telescope section lock, and at least one coupling device configured to couple a telescope section to the telescoping device. The locking head comprises an operating member which mechanically acts on the releasing device and the coupling device in order to operate the releasing device and the coupling device. The operating member comprises a first link guide for the releasing device and a second link guide for the coupling device, and the links for the first and second link guides extend in a single plane or in parallel planes.

In other words, both at least one releasing device and at least one coupling device are mechanically operated via the same operating member of the locking head. The term "mechanically" as used below should be understood as meaning that the operating member transmits forces to the releasing device and to the coupling device. For example, it is conceivable for a fixed body contact to exist between the operating member and a releasing device and a coupling device, respectively. Namely, the operating member acts directly on a releasing device and/or a coupling device or transmits forces at least via one or more dimensionally stable elements to a releasing device and/or a coupling device. The operating member of the locking head proposed by the invention also acts on the releasing device and coupling device in both an operating direction and an opposite return direction. Accordingly, the operating member provides a forced guiding action as it were for the releasing device and coupling device. The link guides each comprise at least one link and at least one element guided in the link. As proposed by the invention, all of the links extend in a single plane or at least in planes extending parallel with one another.

It is conceivable for at least one of the elements guided in the links to co-operate with the operating member or to be fixedly connected to it. However, in the case of a preferred embodiment, all of the links co-operate with the operating member or in other words are integrated in it. The relative movements of the links and the elements guided in them are likewise parallel with one another given the fact that the link planes are parallel.

The telescoping device may comprise a hydraulic telescoping device for example, in order to move the locking head, specifically on the piston rod of the telescoping cylinder, although any other means suitable for this purpose may be used such as electric, hydraulic or pneumatic drives, in particular linear drives, for example. Electric, hydraulic or pneumatic motors could also be used, such as pneumatic cylinders.

The base body of the locking head is preferably fixedly coupled with the telescoping device or with a telescoping device, which is in turn coupled with a fixed base such as the base section of the jib.

The operating member may comprise an integrally formed component. However, it would also be possible for the operating member to be made up of several parts which are fixedly connected to one another and thus form the operating member.

Based on a preferred embodiment of this invention, the operating member is configured such that it can be moved relative to the base body of the locking head, and a movement in translation is more particularly preferred. However, it would also be conceivable for the operating member to be configured such that it can be moved relative to the base body of the locking head in a rotating movement, in addition to which a combination of a translating and rotating movement, in other words a pivoting movement, would also be conceivable. The movement of the operating member relative to the base body of the locking head causes the releasing device and coupling device to be operated.

Based on another preferred embodiment, the releasing device and/or the coupling device comprises at least one element which can be guided in its movement relative to the base body, in particular guided in a translating movement, by means of which the operating member acts on the releasing device or coupling device. In other words, the base body has a guide for elements of the releasing device and/or coupling device, and the operating member is able to act indirectly or directly on these elements in order to operate the releasing device and/or coupling device.

Based on a particularly preferred embodiment, the operating member should be configured such that the individual telescope sections cannot be released from one another via the releasing device until the telescope section lying respectively inwards has already been fixedly coupled with the locking head via the coupling device. On the other hand, the telescope sections cannot be uncoupled from the locking head until they have already been locked to the respective outwardly lying telescope section. This ensures, by way of a single element, namely the operating member, that a telescope section is neither locked to a telescope section lying outward of it nor coupled with the locking head at any time and thus "unsecured".

It is also preferable if the element of the releasing device and/or coupling device which is guided in its movement relative to the base body is guided in a direction extending transversely to, in particular perpendicular to, the direction of movement of the operating member.

The releasing device of the locking head may also comprise an element which is linked in an articulating arrangement about a bearing that is fixed relative to the base body, which couples the movement of the moved and guided element of the releasing device with the movement of the telescope section lock. This articulated element may be a lever in particular, by means of which the movement of the moved and guided element of the releasing device is converted into that of the telescope section lock. With such a lever, it is possible to couple the direction of movement of the moved and guided element of the releasing device and the differing direction of movement of the telescope section lock, for example a guided translating movement of locking bolts. It is also possible, by means of such a lever, to provide a gear ratio between the movement of the moved and guided element of the releasing device and the telescope section lock. It would also be conceivable for a releasing device to comprise a lever mechanism with several elements or levers linked in an articulating arrangement in order to couple the movement of the guided element of the releasing device with that of the telescope section lock.

Based on another preferred embodiment, the locking head has two releasing respectively coupling devices acting in essentially opposite directions. In other words, two telescope section locks lying essentially opposite one another as viewed in the cross-section of the telescope can be released and locked by means of the releasing device using such a locking head. The telescope sections can also be coupled with the locking head at two oppositely lying points. It is also conceivable for the directions in which the releasing and coupling devices act to extend transversely to, in particular perpendicular to, the operating direction of the operating member. The latter may also extend essentially parallel with one another. Specifically, when the locking head is in the fitted state, the latter may extend essentially horizontally.

The return movements may be understood as meaning the movements by which the coupling device is moved so that the locking head is moved out of the coupling or out of engagement with a telescope section and the releasing device moves the telescope section lock into a locked position between individual telescope sections.

A particularly preferred embodiment is one in which both the forced guide/link for the releasing device and the forced guide/link for the coupling device are disposed in an essentially flat portion of the operating member. In other words, both forced guide/links extend essentially in the same plane. It has also been found to be of advantage to maintain an essentially identical extension of these links (the starting and end points of these links are at an essentially identical height along the direction of movement of the operating element).

In order to ensure that the individual telescope sections are either locked to another telescope section or coupled with the locking head at all times, the operating member of a preferred embodiment of this invention may be configured such that the telescope section lock is not released until the relevant telescope section has been coupled with the locking head and the telescoping device, respectively, and the coupling is not released until the relevant telescope section has been locked to another telescope section. This ensures that every individual telescope section is at all times either locked to the other telescope sections of the telescope or coupled with the telescoping device. Finally, this effectively prevents any undesired independent movement of individual telescope sections.

Based on another preferred embodiment of this invention, the operating member is moved relative to the base body via a hydraulic cylinder. However, it would also be conceivable to provide any other actuators suitable for this purpose, for example electric, hydraulic, or pneumatic drives, in particular linear drives. It would also be possible to use electric, hydraulic or pneumatic motors, such as pneumatic cylinders. Since the operating member is the only element needed to operate the coupling device and the locking device, the cylinder(s) acting on the operating member is/are therefore the sole power source for the locking and coupling operations.

Based on another preferred embodiment, a double-acting hydraulic cylinder may be provided, by means of which the operating member and hence the releasing device and coupling device are operated. The double-acting hydraulic cylinder together with the operating member may be configured such that in a middle position, in other words a position of the piston in the hydraulic cylinder approximately centrally between the maximum deflections, the locking head is coupled with the telescope section respectively being moved, whilst this telescope section is additionally locked to the next outwardly lying telescope section, as illustrated in FIG. 5A. The retraction of the hydraulic cylinder from this middle position could cause the telescope section currently being moved to be released from the next outwardly lying telescope section, FIG. 5B, whereas the converse extraction (in other words the opposite movement of the hydraulic cylinder) could cause the telescope section currently being moved to become uncoupled from the locking head (FIG.

5C). In order to switch from the state in which the telescope section being moved is locked to the next outwardly lying telescope section to the state in which this telescope section is coupled with the locking head but is no longer locked to another telescope section, a full cylinder stroke and hence also the "doubly secured" state (locking and coupling of the telescope section) is necessary. Consequently the respective telescope section is at no time totally unsecured, which can in turn be assured by the physical design of the operating member.

Based on another preferred embodiment, the locking head has a return device, which transfers the operating member into a base position. This may be a base position in which the releasing device is not releasing a lock and the coupling device is not coupling a telescope section with the locking head respectively the telescoping device. By preference, however, a base position is one in which the telescope section respectively being moved is "doubly secured" as described above.

Another aspect of this invention relates to a crane, in particular a mobile crane, having a telescope comprising at least two telescope sections, in particular a telescopic crane jib, and a locking head based on one of the embodiments described above co-operating with the telescope.

BRIEF DESCRIPTION OF THE DRAWINGS

The invention will be described in more detail below with reference to an example of an embodiment. It may incorporate the features disclosed below individually or in combination. Of the drawings.

DETAILED DESCRIPTION

Figure 1:
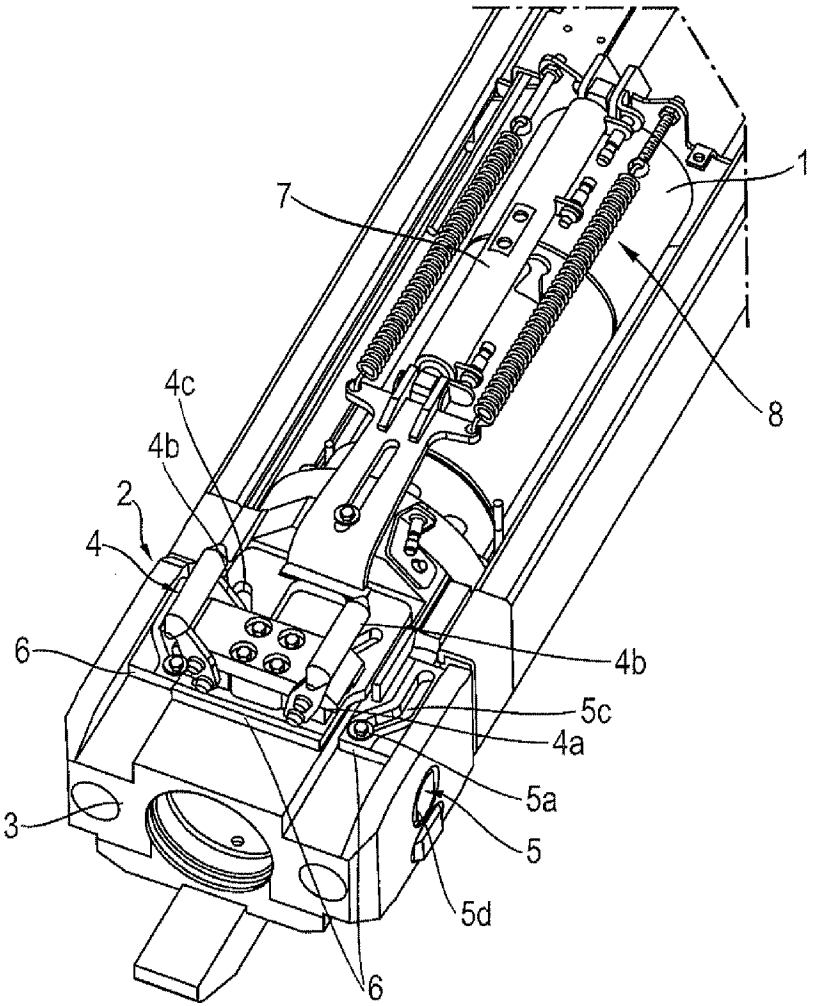
FIG. 1 shows a perspective view of a locking head proposed by the invention.

FIG. 1 illustrates an embodiment of the locking head 2 proposed by the invention, which can be moved via of the telescoping device 1 within a telescopic jib (not illustrated). The locking head 2 is disposed on one end of the telescoping device 1 and is fixedly connected to it. The base body 3 forms the central structure of the locking head 2 and essentially accommodates all the other elements of the locking head 2 or provides a bearing for them.

Provided on both sides of the locking head 2 are guides for bolts 5*d* of the coupling devices 5, and the direction of movement of the bolts 5*d* extends perpendicular to the direction of movement of the locking head 2. By means of these bolts 5*d*, the locking head 2 is coupled with a telescope section to be extended or retracted, the locking bolts 5*d* engaging in co-operating holders on the telescope section.

When the locking head 2 is in the fitted position within a crane jib, the locking head 2 also has two releasing devices 4 disposed at the top, each of which comprises two levers 4*b* which are able to move about a pivot bearing 13 (see FIGS. 9A, 9B) disposed on the base body 3. The levers 4*b* of the releasing devices 4 connect at their ends remote from the base body 3 by means of contact portions, not illustrated, which are able to engage in co-operating holders of a telescope section lock 14 (see FIGS. 7A-7C).

The locking head 2 further comprises an operating member 6, which can be moved parallel with the direction of movement of the locking head 2 and relative to the base body 3. To this end, a hydraulic cylinder 7 is provided, disposed adjacent to the telescoping device 1 and co-operating with the locking head 2, which moves forwards (downwards on the left in FIG. 1) as the operating member 6 is extracted. In order to move the operating member 6 in the opposite direction, tension springs 8 are also provided, which transfer the operating member 6 back into a base position or at least support the cylinder 7 as this happens.

As may also be seen, the operating member 6 has a forced guide element or a link guide 4*c*, 5*c* for both the coupling and releasing devices, in which the co-operating elements, or moved and guided elements, 4*a*, 5*a* of the releasing devices 4 and coupling devices 5, respectively, engage. What is of particular advantage in this respect is that the elements 4*a* and 5*a* engage in the link guides 4*c*, 5*c* of the operating member 6 from different sides, thereby enabling the operating member 6 to be disposed in a space-saving arrangement between the locking mechanism and the coupling mechanism. This means that neither the releasing device nor the coupling device has to move through the other or past it on the operating member 6. The movement of the operating member 6 along the longitudinal axis of the jib likewise contributes to this space-saving solution, as does the flat, horizontally extending orientation of the operating member 6.

As one can easily imagine, as the operating member 6 moves "forwards" (downwards on the left in Figure) relative to the base body 3, the elements 4*a*, 5*a* engaging in the links 4*c*, 5*c* are moved transversely to the direction of movement of the operating member 6 because the other elements of the releasing devices 4 and coupling devices 5 are fixedly guided on the base body 3 of the locking head 2 so that a movement of these elements relative to the base body 3 in the direction of movement of the operating member 6 is not possible.

Figure 2:
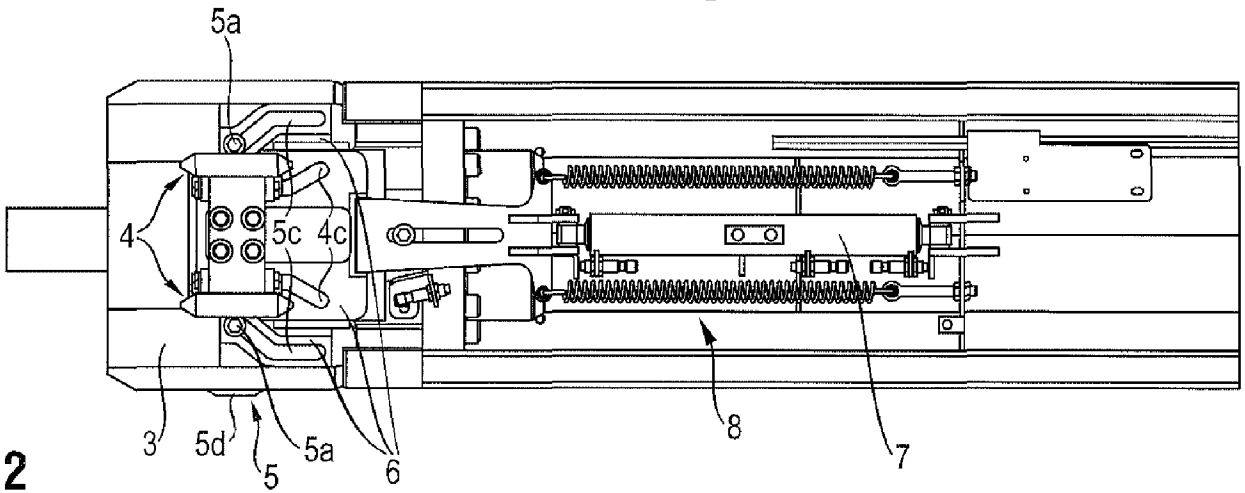
FIG. 2 shows a plan view of the locking head proposed by the invention.

FIG. 2 illustrates the link guide 4*c*, 5*c* of the operating member. As may also be seen, the bolts 5*d* of the coupling devices 5 are moved by means of the link guides 5*c* radially outwards, in other words out of the base body 3, as soon as the operating member 6 is moved out of its base position towards the left in FIG. 2. Accordingly, the locking head 2 is coupled with a telescope section lying around it by means of the coupling devices 5 immediately after the operating member 6 is operated. The elements 5*a* are directly coupled with the bolts 5*d* so that the bolts 5*d* are moved outwards as soon as the elements 5*a* are pushed outwards via the link guide 5*c*. The reverse operation is effected in the corresponding way. As may also be seen, the guides 4*c* and 5*c* are "nested one in the other" with their outermost portions lying at the same end of the operating member 6 (on the right-hand side in FIG. 2) as is the case with their portions lying innermost (on the left in FIG. 2). The double link guide 4*c*, 5*c* is therefore of a very compact design because the links are disposed very closely next to one another. This is also the case, regardless of the latter, because the link guides 4*c*, 5*c* extend horizontally, in other words cause operation of the elements engaging therein along a horizontal direction.

As the operating member 6 continues to move towards the left, operation of the coupling devices 5 is halted because the distance of the co-operating link guides 5*c* no longer changes and instead, the guides 5*c* extend parallel with the direction of movement of the operating member 6. At the end of operating the coupling devices 5, the releasing devices 4 are operated and are so by means of the elements 4*a* moved in a guided arrangement and engaging in the link guides 4*c*. Up to this point in time, the releasing devices 4 remain in their base position because the link guide 4*c* extends parallel with the direction of movement of the operating member 6. However, as the course of the link guides 4*c* changes, in other words their distance increases, the elements 4*a* are moved outwards accordingly, and the movement of the elements 4*a* outwards is converted into an essentially oppositely directed movement of the contact portions, not illustrated, by means of the levers 4*b*. The contact portions, which were moved by means of the locking head 2 into a position in which they engage with co-operating holders of telescope section locking bolts before the operating member 6 was operated, are therefore moved back towards the vertical mid-plane of the locking head 2 and thus "pull" the telescope section locking bolts out of their holders in the respective outer telescope section.

Once the locking head 2 has been coupled with the telescope section to be moved in a telescoping action and the corresponding telescope section lock has been released, the telescope section can be extended or retracted with the aid of the telescoping device 1. Once the desired position of the telescope section has been reached, the reverse operation of the operating member 6 is initiated by means of the hydraulic cylinder 7 and/or by means of the tension springs 8.

Since the moved and guided elements 4*a* of the releasing devices 4 are moved back towards the horizontal mid-plane of the locking head 2, the contact portions together with the bolts of the telescope section lock are first of all moved outwards, thereby locking the coupled telescope section which is then still on the locking head 2. It is not until after the releasing device has been operated and the operating member 6 has been moved farther towards the right that the bolts 5*d* of the coupling devices 5 are pulled back into the base body 3 of the locking head 2 again and the telescope section is thus uncoupled from the locking head 2.

Figure 5A:
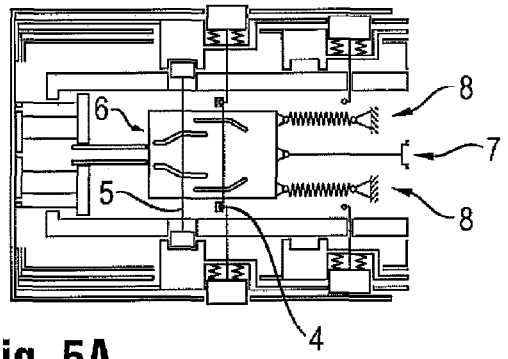
FIGS. 5A-5C is a schematic diagram of an alternative embodiment of the invention.
Figure 5B:
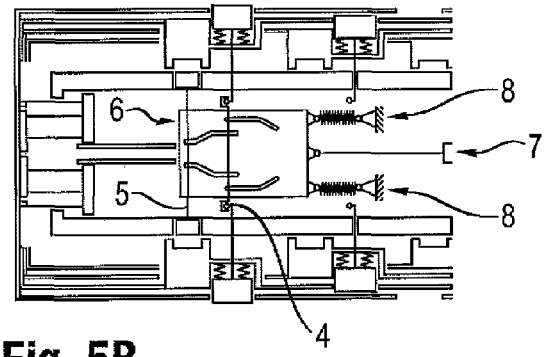
Figure 5C:
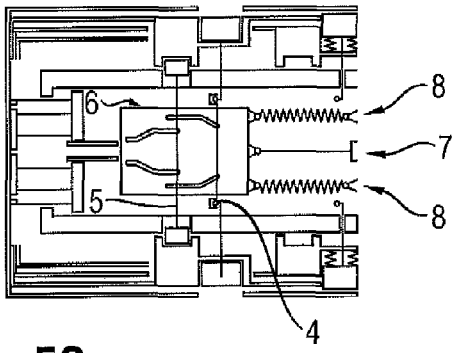

FIGS. 5A to 5C provide schematic illustrations of an alternative embodiment of the locking head proposed by the invention in different positions. As may be seen from FIG. 5A, the hydraulic cylinder 7 and hence also the operating member 6 are in a middle position, which means that operation is possible in one direction as well as in the other direction. In this middle position, the locking head is coupled with the innermost telescope section by the coupling device 5, whilst this telescope section is also locked to the next outwardly lying telescope section. The position illustrated in FIG. 5A is not reached until the hydraulic cylinder 7 has been moved from the position of maximum deflection illustrated in FIG. 5B, in which the locking head is not yet coupled with the telescope section and can therefore be moved within the jib, into the middle position. When the hydraulic cylinder 7 is moved beyond this middle position into the other position of maximum deflection, the two telescope sections are released from one another by means of the releasing device 4, whilst the inwardly lying telescope section is still coupled with the locking head. In this position, the telescope section can finally be moved by means of the telescoping device. The schematically illustrated return device in the form of two springs 8 is constantly trying to urge the hydraulic cylinder 7 and hence also the operating member into the middle position so that the telescope section respectively being moved is secured by both the next outwardly lying telescope section and the locking head.

Figure 6:
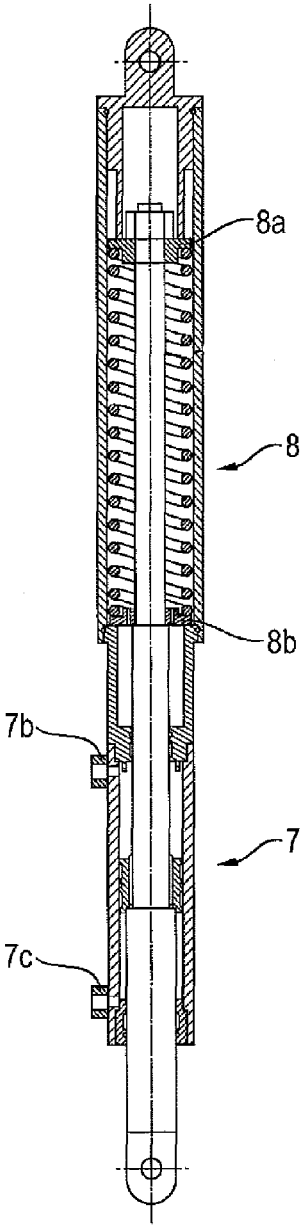
FIG. 6 illustrates a double-acting hydraulic cylinder provided with a return device.

FIG. 6 illustrates a double-acting hydraulic cylinder 7, which is supplied via hydraulic fluid intake lines 7*b* and 7*c*. The return device in the form of a spring 8 is disposed between two spring plates 8*a* and 8*b* and always moves the piston rod into a middle position from which the hydraulic cylinder 7 can be retracted (the annular chamber is pressurised with hydraulic fluid via intake line 7*c*) and extracted (the annular chamber is pressurised via intake line 7*b*).

Figure 4C:
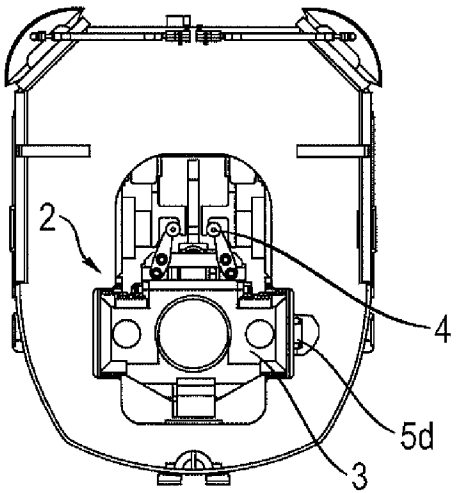
FIGS. 4A-4C illustrate the locking head proposed by the invention in a position fitted within a telescopic crane jib in a non-operating position (left) and in an operated position (right).
Figure 4B:
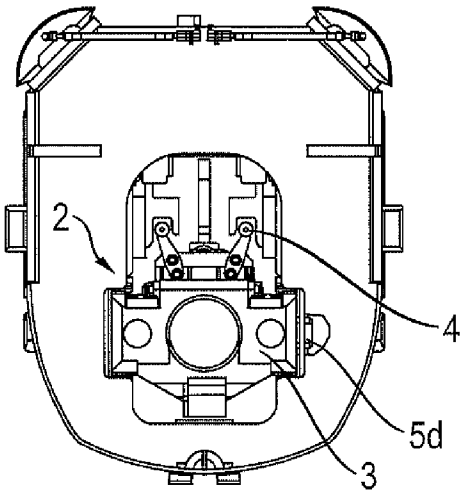
Figure 4A:
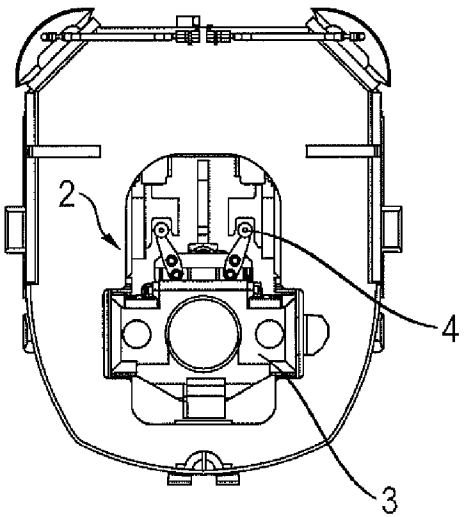
Figure 7C:
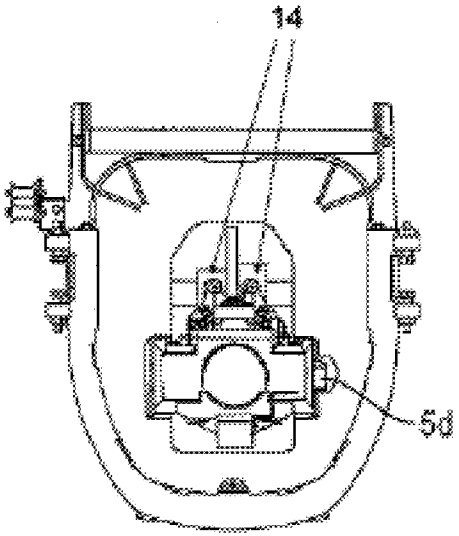
FIGS. 7A-7C illustrate the alternative embodiment of the locking head proposed by the invention in a non-operating position (left) and in an operated position (right).
Figure 7B:
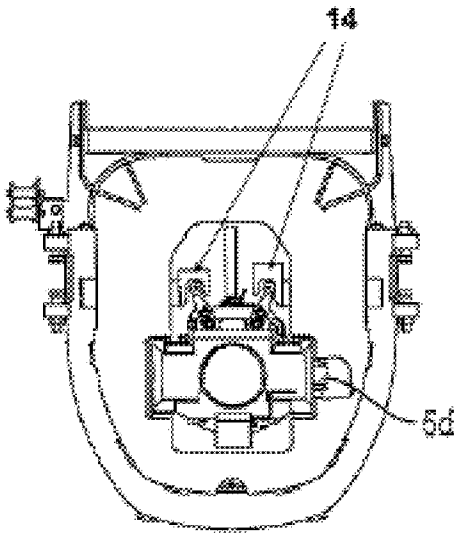
Figure 7A:
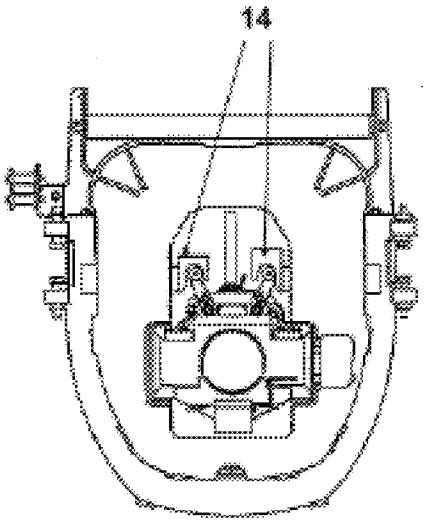

FIGS. 7A-7C illustrates an alternative embodiment of the locking head proposed by the invention in different operating positions corresponding to the positions of the first embodiment illustrated in FIGS. 4A-4C. The left-hand drawing shows the telescope in an unbolted and locked configuration whereas the middle drawing shows the telescope bolted and locked and the right-hand drawing shows the telescope bolted and unlocked.

Figure 3B:
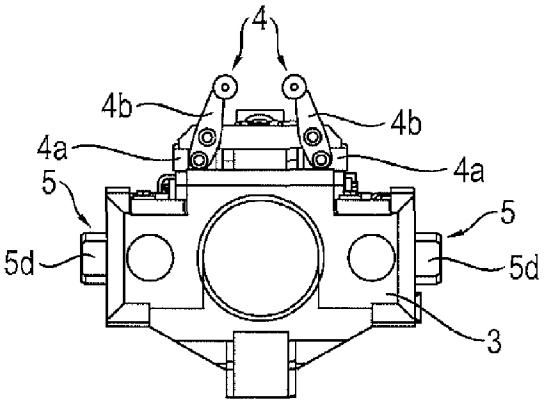
FIGS. 3A-3B illustrate the locking head proposed by the invention in a non-operating position (left) and in an operated position (right).
Figure 3A:
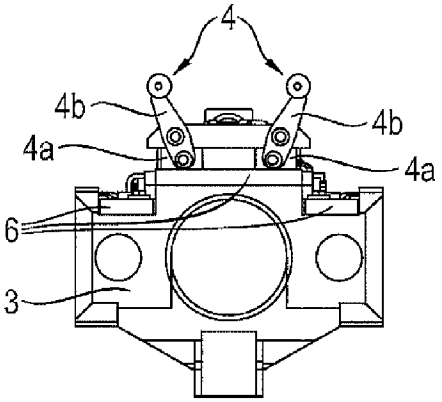
Figure 8:
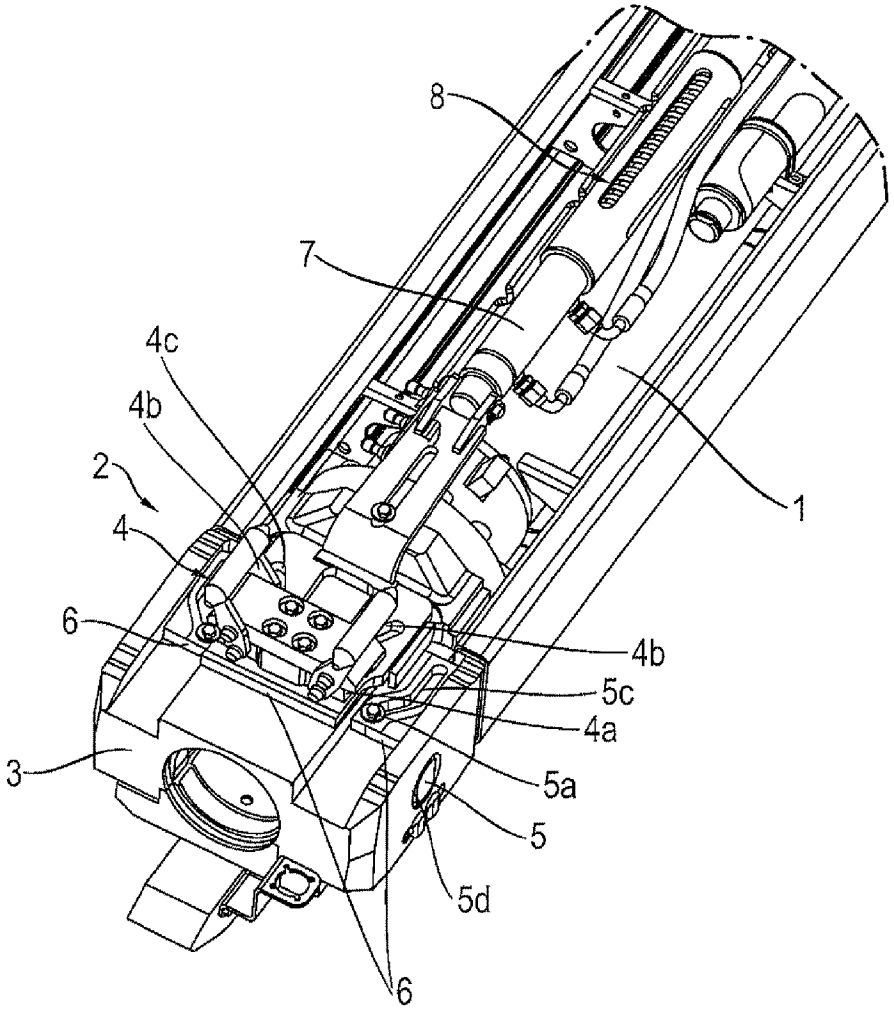
FIG. 8 shows a perspective view of the alternative embodiment.
Figure 9B:
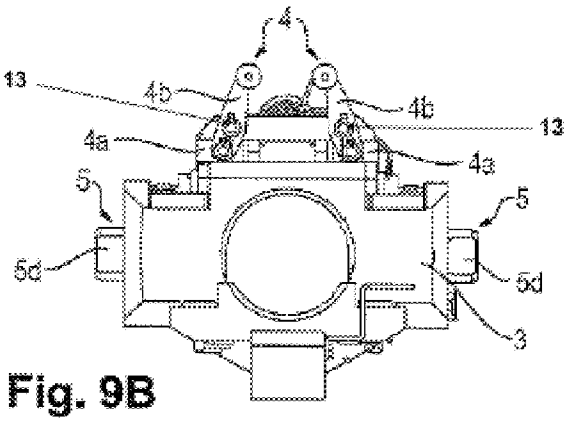
FIGS. 9A-9B illustrate the alternative embodiment in a non-operating position (left) and an operated position (right).
Figure 9A:
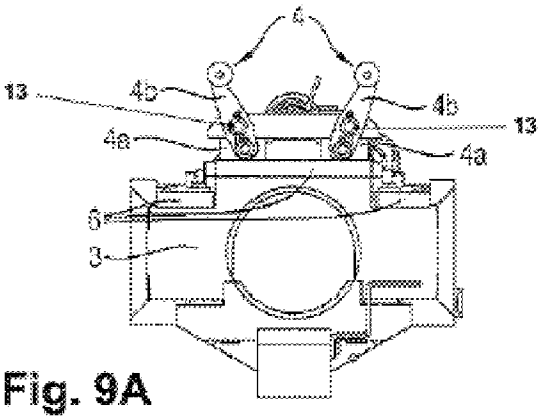
Figure 10:
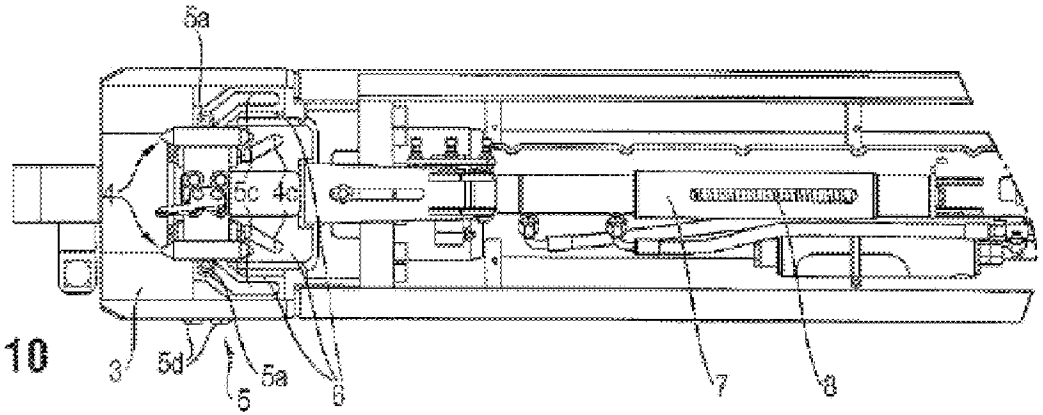
FIG. 10 shows a plan view of the alternative embodiment.

FIG. 8 shows a perspective view of the alternative embodiment of the locking head proposed by the invention. This embodiment essentially corresponds to that illustrated in FIG. 1 but with a double-acting hydraulic cylinder instead of the single-acting hydraulic cylinder shown in FIG. 1. As illustrated, the double-acting hydraulic cylinder 7 is also provided with the return device 8, which in this instance is configured as a spring 8 disposed concentrically with the hydraulic cylinder 7. FIGS. 9A-9B and 10 essentially correspond to FIGS. 3A-3B and 2 and illustrate the alternative embodiment with a double-acting hydraulic cylinder.

Figure 11:
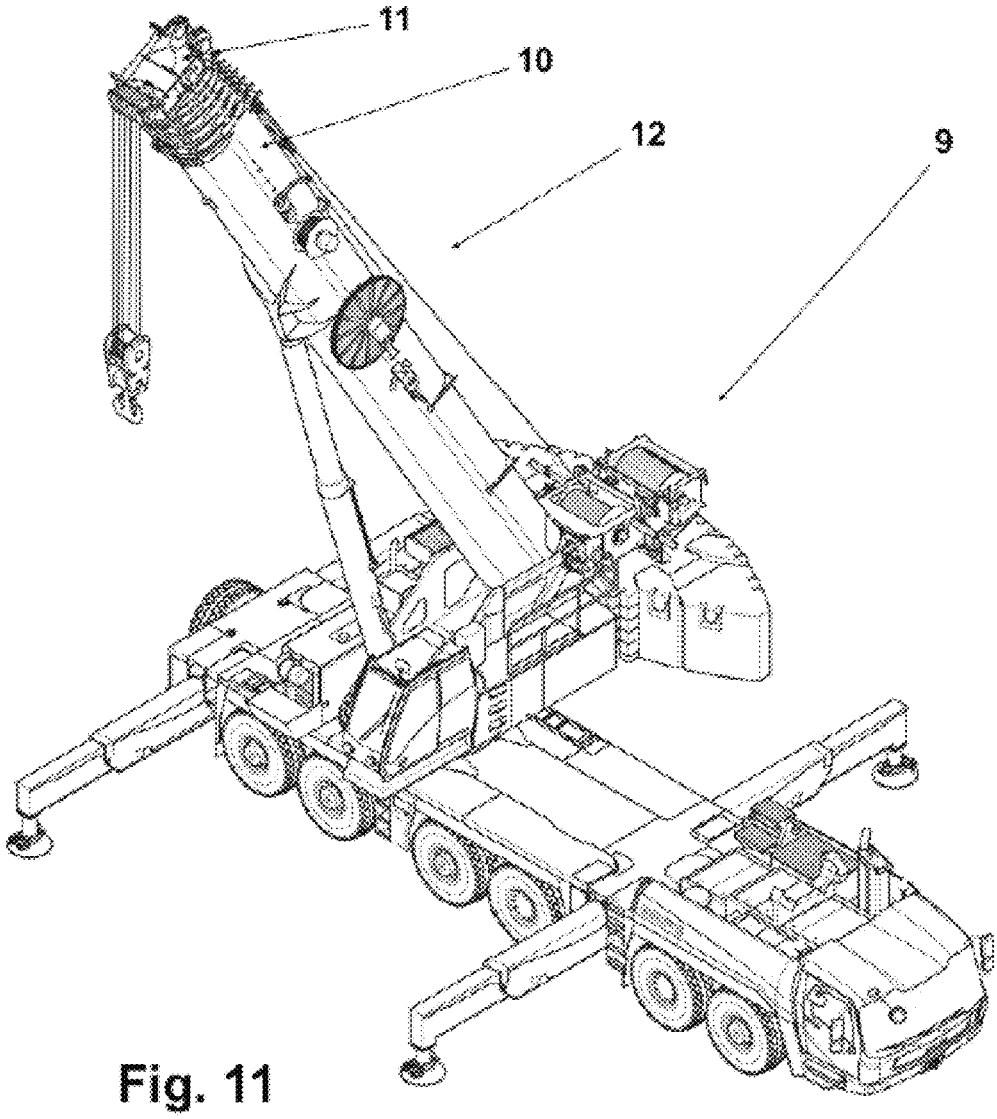
FIG. 11 shows a perspective view of a mobile crane according to an embodiment.

FIG. 11 shows an embodiment of a mobile crane 9, having a telescope comprising at least two telescope sections 10, 11, in particular, a telescopic crane jib 12. A locking head 2 (see FIG. 1, for example) based on one of the embodiments described above co-operates with the telescope. In order to ensure that the individual telescope sections 10, 11 are either locked to another telescope section or coupled with the locking head 2 at all times, the operating member 6 of a preferred embodiment may be configured such that the telescope section lock 14 is not released until the relevant telescope section (one of 10, 11) has been coupled with the locking head 2 and the telescoping device, respectively, and the coupling is not released until the relevant telescope section (one of 10, 11) has been locked to another telescope section (the other of 10, 11). This ensures that every individual telescope section is at all times either locked to the other telescope sections of the telescope or coupled with the telescoping device. Finally, this effectively prevents any undesired independent movement of individual telescope sections.

The invention claimed is:

1. A locking head is configured for movement within and along a longitudinal axis of a telescope comprising at least two telescope sections, via a telescoping device, the locking head comprising:

a base body, at least one releasing device configured to release a telescope section lock, the releasing device operably connected to a first guided element, at least one coupling device configured to couple the telescope sections with the telescoping device, the coupling device operably connected to a second guided element, an operating member which mechanically acts on the releasing device and the coupling device via the first and second guided elements, respectively, in order to operate the releasing device and the coupling device, the operating member comprising a first guiding element for guiding the first guided element and a second guiding element for guiding the second guided element, wherein the first and second guiding elements extend in at least one of a single plane or parallel planes, a double-acting hydraulic cylinder configured to move the operating member relative to the base body, and a return device configured to urge the operating member and the double-acting hydraulic cylinder into a middle position, wherein the middle position is a position in which the releasing device is in a locking position, and in which the coupling device is in a coupling position, wherein deflecting the double-acting hydraulic cylinder from the middle position in a return direction moves the operating member in the return direction causing at least a portion of the first guiding element to apply a first guiding force on the first guided element to move the first guided element, thereby operating the releasing device to move from the locking position to an unlocking position, while the coupling device remains in the coupling position, and wherein deflecting the double-acting hydraulic cylinder from the middle position in an operating direction, opposite to the return direction, moves the operating member in the operating direction causing at least a portion of the second guiding element to apply a second guiding force on the second guided element to move the second guided element, thereby operating the coupling device to move from the coupling position to an uncoupling position while the releasing device remains in the locking position.

2. The locking head as claimed in claim 1, wherein at least one of the first guided element and second guided element is guided in a direction extending transversely to the direction in which the operating member is moved.

3. The locking head as claimed in claim 2, wherein at least one of the releasing device and the coupling device is guided in a direction perpendicular to the direction in which the operating member is moved in a translatory manner.

4. The locking head as claimed in claim 1, wherein the releasing device comprises a lever linked in an articulating arrangement about a bearing that is fixed relative to the body, the lever being configured to couple the movement of the first guided element of the releasing device with a movement of the telescope section lock.

5. The locking head as claimed in claim 1, having at least two releasing and coupling devices, respectively, acting in opposite directions.

6. The locking head as claimed in claim 5, wherein the directions in which the releasing and coupling devices are configured to extend horizontally.

7. The locking head as claimed in claim 1, wherein the return device is provided in the form of at least one spring.

8. A mobile crane having the telescope comprising the at least two telescope sections, and the locking head as claimed in claim 1 co-operating with the telescope.

9. The locking head as claimed in claim 1, wherein the operating member is configured to be moved relative to the base body in a translatory manner.

10. The locking head as claimed in claim 1, wherein the first and second guided elements are configured to be moved in a translatory manner.

11. A locking head configured to be moved via a telescopic device, the locking head and the telescopic device configured to be positioned within a telescopic jib of a crane, the telescopic jib including a longitudinal axis along which the telescopic device and the locking head is movable, and the telescopic jib further including at least two telescope sections configured to move relative to each other, the locking head comprising:

a base body;

at least one releasing device configured to couple the locking head with a telescope section lock, the at least one releasing device operably coupled to a first movable guided element;

at least one coupling device configured to couple the locking head to at least one of the telescope sections, the at least one coupling device operably coupled to a second movable guided element;

an operating member having a first side and a second side spaced apart from the first side, a first guiding element and a second guiding element, wherein the operating member is movable relative to the base body in an operating direction and a return direction opposite to the operating direction; and a return device configured to urge the operating member into a middle position, wherein the middle position is a position in which the releasing device is in a locking position, and in which the coupling device is in a coupling position, wherein the first movable guided element is engaged in the first guiding element from at least one of the first side and the second side of the operating member, and movement of the operating member from a middle position over a first length in the return direction, causes the first guiding element to move the first movable guided element to operate the releasing device between a locking position and an unlocking position while the coupling device is in a coupling position, and wherein the second movable guided element is engaged in the second guiding element and movement of the operating member from the middle position over a second length in the operating direction, causes the second guiding element to move the second guided element to operate the coupling device between the coupling position and an uncoupling position while the releasing device is in the locking position.

12. The locking head of claim 11, wherein the second movable guided element engages the second guiding element from at least one of the first side and the second side of the operating member that is different from the side from which the first movable guided element engages the first guiding element.

* * * * *